US005820406A

United States Patent [19]

Hetherington

[11] Patent Number: 5,820,406

[45] Date of Patent: Oct. 13, 1998

[54] TERMINAL AND DOOR LATCH FOR BATTERY OPERATED DEVICES

[76] Inventor: Michael Warnett Hetherington, R.R. 1, Mount Albert Ontario, Canada, L0G 1M0

[21] Appl. No.: 688,140

[22] Filed: Jul. 29, 1996

[51] Int. Cl.[6] ..... H01R 3/00

[52] U.S. Cl. ..... 439/500; 429/98; 340/628; 340/693

[58] Field of Search ..... 439/500, 911; 429/97, 98, 99, 100; 340/691, 693, 628, 632, 636

[56] References Cited

U.S. PATENT DOCUMENTS

| | | | |
|---|---|---|---|
| 3,473,966 | 10/1969 | Fritch | 429/98 |
| 4,228,428 | 10/1980 | Niedermeyer | 340/693 |
| 4,849,743 | 7/1989 | Ohno | 340/687 |
| 4,870,395 | 9/1989 | Belano | 340/693 |
| 4,881,063 | 11/1989 | Fawcett | 340/693 |
| 4,959,640 | 9/1990 | Hall | 340/693 |
| 5,055,830 | 10/1991 | Cousins et al. | 340/693 |
| 5,373,133 | 12/1994 | Brockway et al. | 200/335 |
| 5,442,337 | 8/1995 | Hwang | 340/635 |
| 5,596,314 | 1/1997 | Goldstein | 429/100 |
| 5,646,598 | 7/1997 | Nickles et al. | 340/693 |

*Primary Examiner*—Gary F. Paumen
*Assistant Examiner*—Tho D. Ta
*Attorney, Agent, or Firm*—Ridout & Maybee

[57] ABSTRACT

A battery terminal and door latch for battery operated devices. The battery terminal and door latch assembly prevents the closure of a battery compartment door when one or more batteries are missing from the battery operated device. In the embodiment, the terminal includes an aperture for engaging a latch on the compartment door. When a battery is installed the terminal is deflected so that the aperture engages the latch to close the door. Without an installed battery, the terminal is biased to prevent the aperture from engaging the latch. The open battery compartment door provides a readily discernible indication that batteries have not been installed. The terminal and door latch assembly is suitable for use with smoke detectors, carbon monoxide detectors and the like.

6 Claims, 4 Drawing Sheets

TERMINAL AND DOOR LATCH FOR BATTERY OPERATED DEVICES

FIELD OF THE INVENTION

The present invention relates to battery-powered devices such as carbon monoxide detectors, smoke detectors and the like, and more particularly to a battery terminal and door latch mechanism for such devices.

BACKGROUND OF THE INVENTION

The advent of smoke detectors has led to the saving of countless lives each year. The effectiveness and decreasing costs of smoke detectors has resulted in their widespread use. More recently, carbon monoxide detectors have found growing appeal and use in both residential and commercial applications. Carbon monoxide detectors include an active element which is sensitive to carbon monoxide, and like smoke detectors, a loud alarm is activated upon detection of dangerous levels of carbon monoxide.

The trend has been to make smoke and carbon monoxide detectors battery-powered. While there are known line-powered devices, battery-powered devices have the advantage of not being susceptible to electrical supply brown-outs or outages.

The principal drawback with battery-powered detectors is the need to ensure that the batteries have been loaded and that the batteries are sufficiently charged to power the detector.

When a smoke detector is accidently activated, for example from food burning on a stove element, there is a tendency to quickly silence the smoke detector by pulling out the batteries. While such an action is effective to deactivate the detector, there is always the risk that the batteries will not be replaced immediately, and as a result the smoke detector will remain in an inactive state.

More recently, certain regulatory bodies, for example Underwriters Laboratories (UL) in the United States, are requiring that some warning be given when batteries are missing from some types of safety devices such as smoke detectors.

Accordingly, there is a need in the art for a device which can be applied to carbon monoxide, smoke detectors and the like, which provides a visible indication that batteries have not been installed in the detector and which also can prevent the detector from being mounted in position without batteries installed.

BRIEF SUMMARY OF THE INVENTION

The present invention provides a battery terminal and door latch arrangement particularly suited for application to smoke detectors, carbon monoxide detectors and the like. The battery terminal and door latch arrangement advantageously provide a visual indication that batteries have not been loaded in the detector and that therefore the detector is inoperable. In another aspect, the present invention prevents the detector from being mounted in position, e.g. on a wall bracket or ceiling bracket, if all the batteries are not installed.

A feature of the present invention is the arrangement of the battery terminals and the door latch assembly to provide a visual warning that batteries are missing from the detector. The arrangement has the advantage of providing the warning without unduly adding parts or complexity to the detector.

In a first aspect, the present invention provides an apparatus for preventing closure of a battery compartment cover in a battery compartment for a battery powered device when the device is missing one or more batteries, said apparatus comprising: (a) latch means for latching said battery compartment cover in a closed position; (b) terminal means for contacting a terminal of said battery and providing an electrical connection; and (c) said terminal means including engaging means for engaging said latch means and said engaging means being operative to engage said latch means when a battery is mounted in said battery compartment, so that said battery compartment cover is latched in said closed position.

In a second aspect, the present invention provides in combination with a battery-powered safety detector, an apparatus for preventing closure of a cover door and providing an indication when one or more batteries are missing from a battery compartment in the safety detector, said apparatus comprising: (a) latch means for latching said cover door in a closed position; (b) terminal means for contacting a terminal of said battery and providing an electrical connection; and (c) said terminal means including engaging means for engaging said latch means and said engaging means being operative to engage said latch means when a battery is mounted in said battery compartment, so that the cover door is latched in said closed position indicates installation of said batteries.

BRIEF DESCRIPTION OF THE DRAWINGS

Reference will now be made to the accompanying drawings which show, by way of example, preferred embodiments of the present invention, and in which:

FIG. 2(*b*) is a sectional view of the detector housing of FIG. 2(*a*) taken through line 2—2;

FIG. 2(*c*) is a sectional view of the detector housing of FIG. 2(*a*) taken through line 3—3;

FIG. 3(*b*) is another view of the arrangement of FIG. 3(*a*) with batteries installed in the device;

FIG. 4(*b*) and 4(*c*) are alternate views of the battery terminal and door latch arrangement of FIG. 4(*a*) with batteries in place (FIG. 4(*b*)) and batteries missing (FIG. 4(*c*)).

DETAILED DESCRIPTION OF THE PREFERRED EMBODIMENTS

Figure 1:
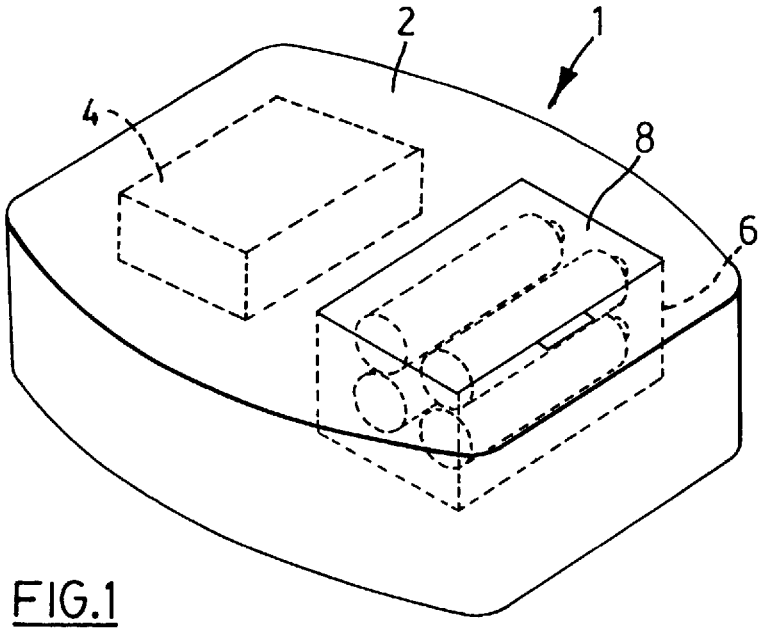
FIG. 1 is a perspective view of a detector of the type suitable for a battery terminal and door latch arrangement according to the present invention.

Reference is first made to FIG. 1 which shows a detector 1 of the type suitable for utilizing a battery terminal and door latch assembly according to the present invention. The detector 1 comprises a housing 2 which contains an active sensing element and associated electronic circuitry denoted generally by 4.

The detector 1 of interest is of the battery-powered type, and accordingly the detector 1 includes a battery compartment 6 for receiving batteries B. The battery compartment 6 is accessed through a cover door 8. The cover door 8 is secured by a door latch and battery assembly according to the present invention.

In the figures, like elements and components have like references.

As will now be described with reference to FIGS. 2–4, a battery terminal and door latch arrangement 10 according to the present invention prevents the cover door 8 from being closed unless the required number of batteries B are installed in the detector 1. The open (or missing) cover door 8 provides a visual indication that the detector 1 is missing batteries B and is therefore inoperative.

Figure 2C:
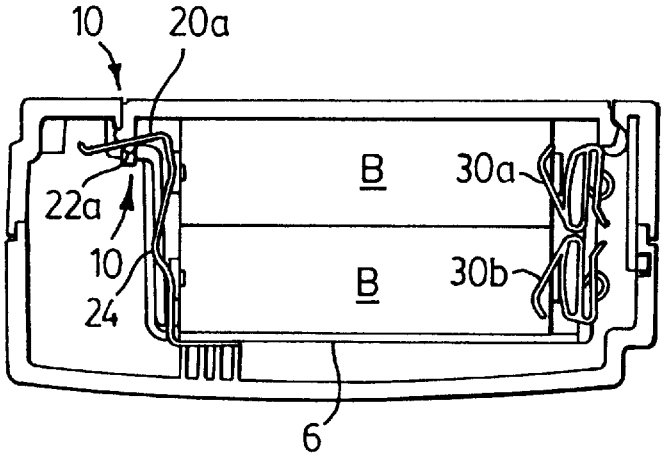
FIG. 2(*a*) is a top view of the detector housing showing the battery terminal and door latch mechanism.
Figure 2A:
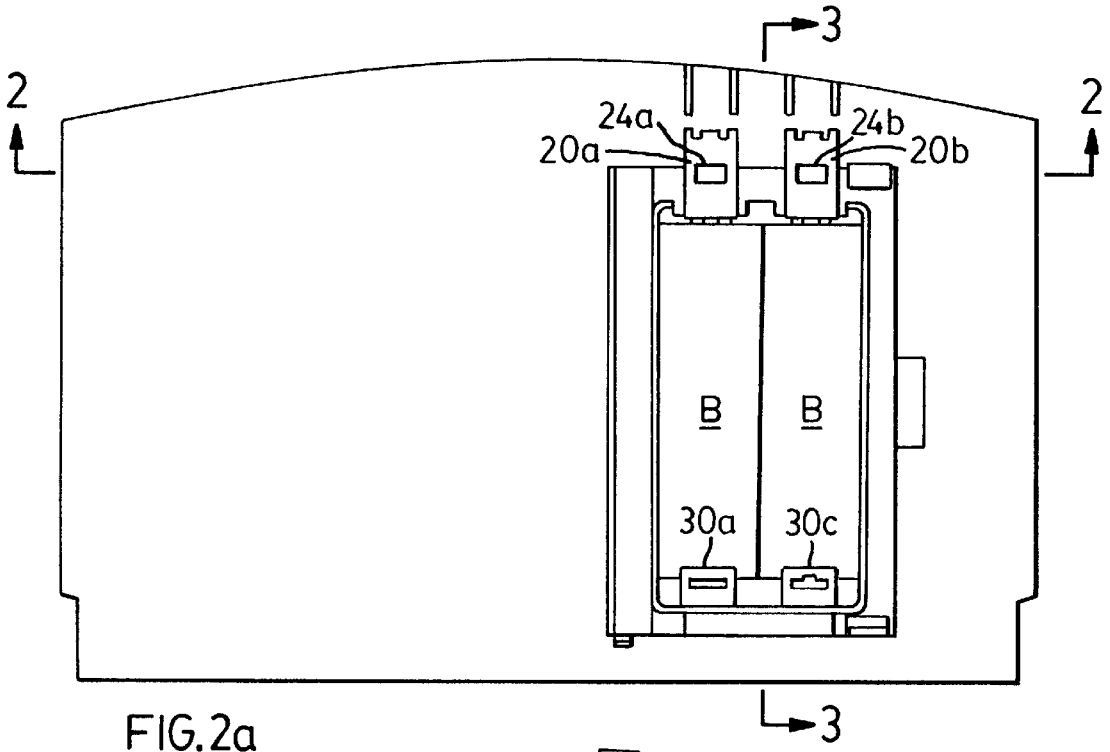
Figure 2B:
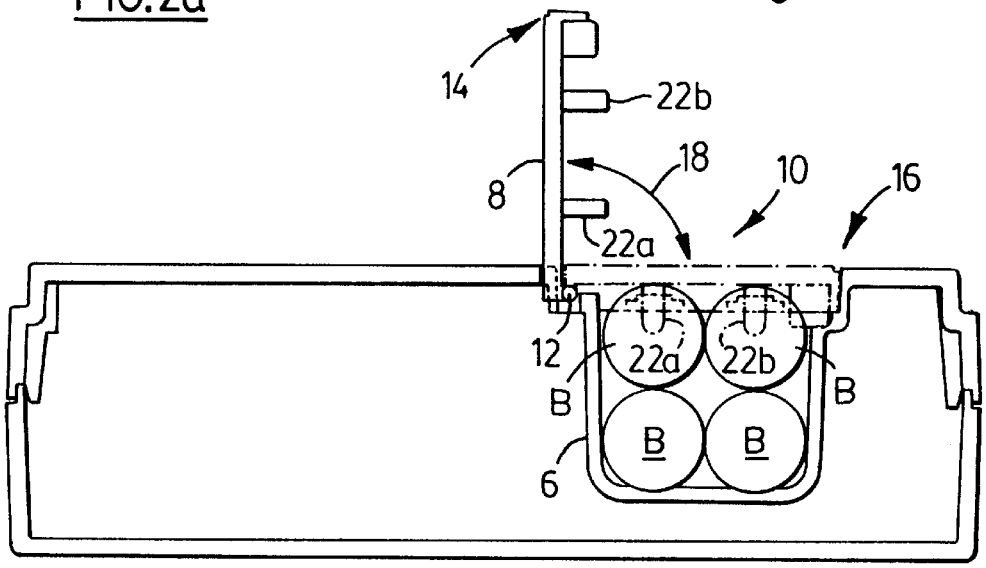
Figure 3A:
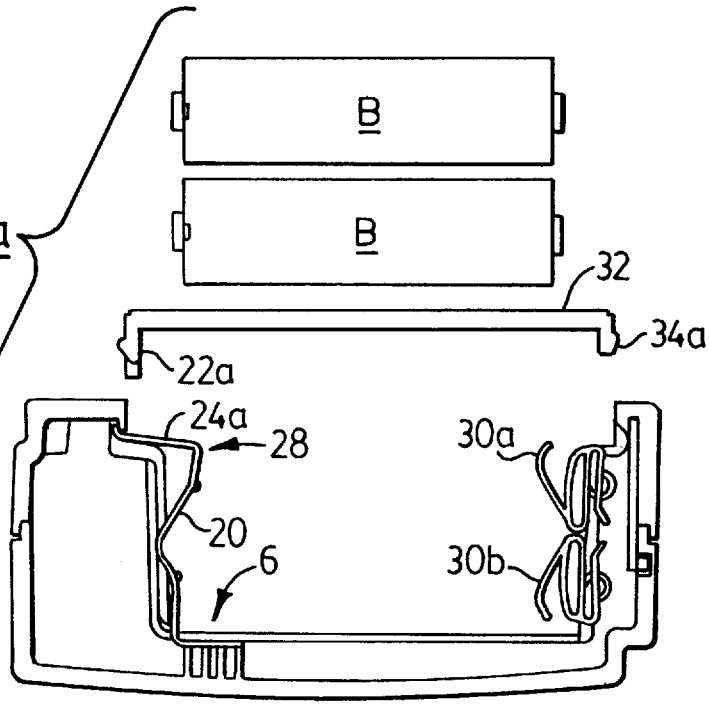
FIG. 3(*a*) is a sectional view of a detector housing incorporating a second embodiment of a battery terminal and door latch arrangement according to the present invention.

Referring to FIG. 2(*b*), the cover door 8 is connected to the housing 2 by a hinge/pin 12 of known design. The cover door 8 swings between an open position 14 and a closed position 16 as indicated by arrow 18. When batteries B are installed in the compartment 6, the cover door 8 snaps into the closed position 16 shown in dashed outline.

The battery terminal and door latch arrangement 10 according to the present invention comprises one or more spring contacts 20, shown individually as 20*a*, 20*b* in FIG. 2(*a*), and one or more latch protrusions 22, shown individually as 22*a*, 22*b* in FIG. 2(*b*) and fixed (or formed) on the bottom of the cover door 8. The spring contacts 20*a*, 20*b* have respective apertures 24*a*, 24*b* which are displaced to communicate with the respective latch protrusions 22*a*, 22*b* when the batteries B are installed in the battery compartment 6. The spring contacts 20 are formed from a suitable electrical conductive material, e.g. metal strip or sheet, with a bend 26. When there are no batteries B installed, the bend 26 in the contacts 20 presses against the wall of the battery compartment 6 and biases the apertures 24 to a position 28 (FIG. 3*a*) in which the apertures 24 do not register with the latch protrusions 22. This prevents the cover door 8 from being closed when the batteries B have not been installed and the open cover door 8 provides a visual indication that batteries are missing from the detector 1. As shown in FIG. 2(*c*), the spring contacts 20 cooperate with terminal contacts 30 (shown individually as 30*a*, 30*b* and 30*c* in the figures) to complete the electrical (e.g. series) connection for the batteries B.

Figure 3B:
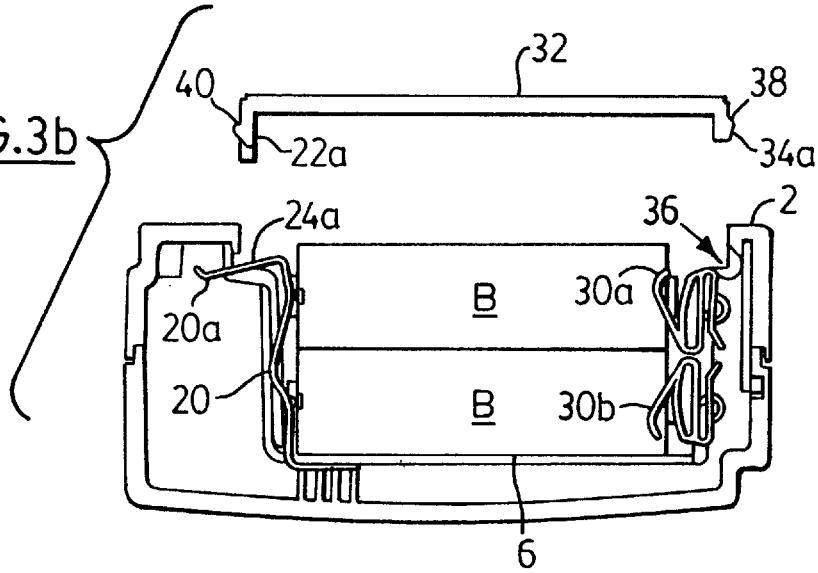

Referring to FIGS. 3(*a*) and 3(*b*), the hinged cover door 8 is replaced by a cover door 32 which snaps into the back of the housing 2 to cover the battery compartment 6. When the batteries B are installed as shown in FIG. 3(*b*) the spring contacts 20 are deflected, latch protrusions 22 on the cover door 32 register with the respective apertures 24 and latch protrusions 34 (which replace the hinge 12) register with respective locking slots 36 formed in the housing 2, and the cover door 32 is latched into a closed position. Preferably, the latch protrusion 34 (shown individually as 34*a* in FIGS. 3(*a*) and 3(*b*)) includes a flange edge 38 for engaging the slot 36. Similarly, the latch protrusion 22 preferably includes a bevelled flange edge 40 for engaging the aperture 24. The bevelled flange edge 40 facilitates disengaging the latch 22 from the aperture 24 for removing the cover door 32 to access the battery compartment 6.

Figure 4A:
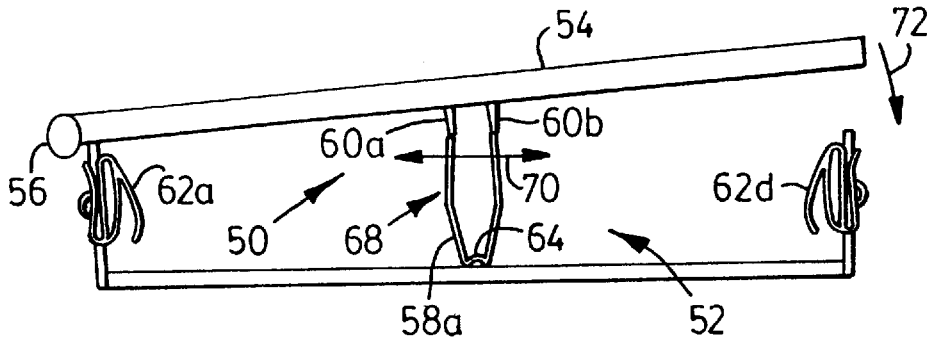
FIG. 4(*a*) is a sectional view of another embodiment of a battery terminal and door latch arrangement according to the present invention.
Figure 4B:
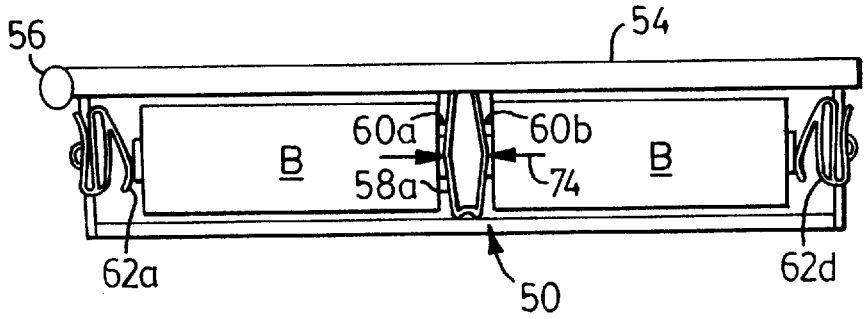
Figure 4C:
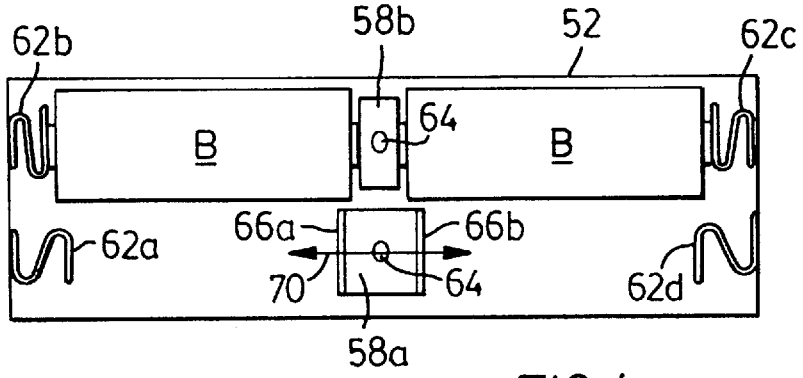

Reference is next made to FIGS. 4(*a*) to 4(*c*) which show another embodiment of a battery terminal and door latch arrangement 50 according to the present invention. In this arrangement, the batteries B are mounted horizontally and end-to-end in a battery compartment 52. The battery compartment 52 is closed by a cover door 54 which is conventionally connected at hinge/pin 56. The latch arrangement 50 comprises spring contacts 58, shown individually as 58*a* and 58*b*, and latch protrusions 60, shown individually as 60*a*, 60*b*. Battery terminal contacts 62, shown individually as 62*a*, 62*b*, 62*c* and 62*d* are also provided in the battery compartment 52 in order to the complete the electrical (i.e. series) connection of the batteries B.

Referring to FIG. 4(*a*), the spring contacts 58 are mounted in the centre of the battery compartment 52 using a suitable fastener 64, for example, a grommet. The spring contacts 58 are formed from a suitable electrically conductive metal strip or sheet and have a generally "U-shape" with prong ends 66, shown individually as 66*a* and 66*b* for the contact 58*a* (FIG. 4(*c*)). The spring contacts 58 are formed with a bend 68 which biases the prong ends 66 outwardly (as indicated by arrow 70) when one or more batteries are not installed in the compartment 52. The outward displacement of the ends 66*a*, 66*b* brings them into contact with the latch protrusions 60*a*, 60*b* when the cover 54 is moved to closed position 72 and prevents the cover 54 from being closed. The open cover door 52, in turn, indicates that batteries B are not installed, and in the case the of devices 1 which are held in a wall or ceiling bracket the open door prevents the device 2 from being mounted in the bracket.

Referring next to FIG. 4(*b*), when batteries B are installed in the compartment 52, the spring contacts 58 are compressed and the prong terminals 66*a* are displaced inwardly (as indicated by arrow 74). The compression of the spring contact 58 should be sufficient to bring the prong ends 66 within the latch protrusions 60 as shown in FIG. 4(*b*) thereby allowing the cover door 54 to be closed.

Referring to FIG. 4(*c*), it will be appreciated that only one missing battery B prevents the cover door 54 from being closed. Similarly for the embodiments shown in FIGS. 2 and 3, a missing battery prevents the door 8 (32 in FIG. 3) from being secured in the closed position. It will also be appreciated that the battery terminal and door latch arrangement is suitable with slight modification for devices powered by a single battery, for example, a 9-Volt battery.

Summarizing, the present invention provides an effective mechanism for preventing the closure of the battery compartment door in a smoke detector, carbon monoxide detector or the like, when there are no batteries installed or a battery is missing. This in turn provides a readily discernible indication that the detector is without batteries and therefore inoperable. The arrangement has the additional advantage of being simple and inexpensive to manufacture and does not add parts or substantially increase the complexity of detectors.

The present invention may be embodied in other specific forms without departing from the spirit or central characteristics thereof. Therefore, the presently discussed embodiments are considered to be illustrative and not restrictive. The scope of the invention being indicated by the appended claims rather than the foregoing description, and all changes which come within the meaning and range of equivalency of the claims are therefore intended to be embraced therein.

What is claimed is:

1. An apparatus for preventing closure of a battery compartment cover in a battery compartment for a battery powered device when one or more batteries are missing from the battery compartment, said apparatus comprising:

(a) latch means for latching said battery compartment-cover in a closed position;

(b) terminal means for contacting a terminal of said battery and providing an electrical connection;

(c) said terminal means including engaging means for engaging said latch means and said engaging means being operative to engage said latch means when the battery is mounted in said battery compartment; and (d) wherein said engaging means comprises an aperture formed in said terminal means for receiving said latch means, said engaging means having means responsive to insertion of a battery for moving said aperture from a latch blocking position to a latch enraging position for receiving said latch means so that said battery compartment cover is movable to said closed position.

2. The apparatus as claimed in claim 1, wherein said terminal means comprises a metal strip having a flexing bend biased to maintain said aperture in said latch blocking position in the absence of a battery.

3. The apparatus as claimed in claim 1, wherein said latch means comprises a projection for said aperture, said projection being fixed to said battery compartment cover and having dimensions for fitting said aperture.

4. In combination with a battery-powered safety detector, an apparatus for preventing closure of a cover door and providing an indication when one or more batteries are missing from a battery compartment in the safety detector, said apparatus comprising:

(a) latch means for latching said cover door in a closed position;

(b) terminal means for contacting a terminal of said battery and providing an electrical connection;

(c) said terminal means including engaging means for engaging said latch means and said engaging means being operative to engage said latch means when the battery is mounted in said battery compartment; and (d) wherein said engaging means comprises an aperture formed in said terminal means for receiving said latch means, said engaging means having deflecting means responsive to insertion of one of said batteries for moving said aperture from a latch blocking position to a latch enraging position so that said cover door is latchable in said closed position.

5. The apparatus as claimed in claim 4, wherein said safety detector comprises a smoke detector.

6. The apparatus as claimed in claim 4, wherein said safety detector comprises a carbon monoxide detector.

* * * * *